US009205313B2

(12) United States Patent
Pactanac et al.

(10) Patent No.: US 9,205,313 B2
(45) Date of Patent: Dec. 8, 2015

(54) LIGHTWEIGHT MODULAR GOLF BAG HAVING EXTERNAL FRAME

(75) Inventors: Pierre A. Pactanac, Portland, OR (US); Heather L. Herron, Portland, OR (US); Jeffrey W. Wear, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 731 days.

(21) Appl. No.: 13/273,651

(22) Filed: Oct. 14, 2011

(65) Prior Publication Data

US 2013/0092573 A1 Apr. 18, 2013

(51) Int. Cl.
*A63B 55/00* (2015.01)
*A63B 55/02* (2006.01)

(52) U.S. Cl.
CPC ..... *A63B 55/00* (2013.01); *A63B 55/008* (2013.01); *A63B 55/02* (2013.01); *A63B 2210/50* (2013.01); *A63B 2225/682* (2013.01)

(58) Field of Classification Search
USPC ..... 206/315.6, 315.5, 315.8, 315.3; 224/628, 634, 633, 635
See application file for complete search history.

(56) References Cited

U.S. PATENT DOCUMENTS

| | | | |
|---|---|---|---|
| 1,254,640 | A | 1/1918 | Stevenson |
| 1,409,323 | A | 3/1922 | Welis |
| 1,444,357 | A | 2/1923 | Madison |
| 1,498,910 | A | 6/1924 | Harpham |
| 1,899,825 | A | 2/1933 | Reach |
| 2,070,254 | A | 2/1937 | Burgner |
| 2,507,249 | A | 5/1950 | Dorazio |
| 2,791,255 | A | 4/1955 | Ogden |
| 2,799,315 | A | 7/1957 | Strasburg |
| 3,147,786 | A | 9/1964 | Kish |
| 3,860,157 | A | 1/1975 | Richards et al. |
| 3,912,138 | A | 10/1975 | Pava |
| 3,938,718 | A | 2/1976 | Madison |
| 4,099,657 | A | 7/1978 | Zufich |
| 4,248,367 | A | 2/1981 | Buel |
| 4,249,586 | A | 2/1981 | Setani |
| 4,266,589 | A | 5/1981 | Cochran |

(Continued)

FOREIGN PATENT DOCUMENTS

| | | |
|---|---|---|
| JP | 2003052877 A | 2/2003 |
| WO | 03061776 | 7/2003 |

OTHER PUBLICATIONS

International Search Report and Written Opinion dated Jan. 7, 2013 for PCT/US2012/060025; filed Oct. 12, 2012.

(Continued)

*Primary Examiner* — Tri Mai
(74) *Attorney, Agent, or Firm* — Shook, Hardy & Bacon L.L.P.

(57) ABSTRACT

A modular golf bag having an external frame is provided. A plurality of poles connect a frame top capable of receiving golf clubs to a frame bottom. A pliable bag body internal to the plurality of poles extends between the frame top and the frame bottom such that a cavity capable of receiving golf clubs through the frame top is formed. A plurality of pole sleeves are attached to the pliable bag body. Each pole sleeve surrounds at least a portion of the length of a pole such that each pole runs through at least one pole sleeve. The plurality of pole sleeves provide structure to the pliable bag body by securing the pliable bag body to the plurality of poles in an extended position. At least one additional storage compartment may be detachably connected between at least two of the plurality of poles.

9 Claims, 5 Drawing Sheets

(56) References Cited

U.S. PATENT DOCUMENTS

| | | | | |
|---|---|---|---|---|
| 4,350,194 | A | 9/1982 | Brown | |
| 4,378,039 | A | 3/1983 | Suk | |
| 4,438,876 | A | 3/1984 | Ward | |
| 4,448,305 | A | 5/1984 | Sup | |
| 4,673,070 | A | 6/1987 | Ambal | |
| D296,092 | S * | 6/1988 | Dzeskewicz | D12/133 |
| 4,796,752 | A | 1/1989 | Reimers | |
| 4,895,198 | A | 1/1990 | Samuelson | |
| 5,038,984 | A | 8/1991 | Izzo | |
| 5,222,598 | A * | 6/1993 | Yamazoe | 206/315.5 |
| 5,314,063 | A | 5/1994 | Lee et al. | |
| 5,465,839 | A | 11/1995 | Gretz | |
| 5,482,160 | A | 1/1996 | Perrin | |
| 5,632,071 | A * | 5/1997 | Maunder | 24/580.1 |
| 5,632,496 | A | 5/1997 | Nelson | |
| 5,769,220 | A | 6/1998 | Hong | |
| 5,941,383 | A | 8/1999 | Cheng | |
| 6,024,265 | A | 2/2000 | Clements | |
| 6,227,503 | B1 | 5/2001 | Shiao Chen | |
| 6,330,944 | B1 * | 12/2001 | DeMichele | 206/315.3 |
| 6,415,919 | B1 | 7/2002 | Keller | |
| 6,478,151 | B1 | 11/2002 | Schmidt et al. | |
| 6,637,590 | B1 | 10/2003 | Matsuki | |
| 6,651,853 | B2 | 11/2003 | Higgins et al. | |
| 6,736,264 | B2 | 5/2004 | Yoshida | |
| 6,994,050 | B2 * | 2/2006 | Johnson et al. | 114/343 |
| 7,650,990 | B2 | 1/2010 | Tan | |
| 7,780,002 | B2 | 8/2010 | Manaster et al. | |
| 2003/0094390 | A1 | 5/2003 | Thompson et al. | |
| 2003/0168362 | A1 * | 9/2003 | Yoshida | 206/315.7 |
| 2004/0108350 | A1 | 6/2004 | Warren | |
| 2005/0072695 | A1 | 4/2005 | Shaanan | |
| 2008/0006548 | A1 * | 1/2008 | Shiao | 206/315.3 |
| 2010/0051489 | A1 | 3/2010 | Shiao | |
| 2011/0073504 | A1 | 3/2011 | Aubry et al. | |
| 2011/0162985 | A1 | 7/2011 | Shiao | |

OTHER PUBLICATIONS

International Search Report and Written Opinion dated Jan. 22, 2013 for PCT/US2012/060028; filed Oct. 12, 2012.

Office Action of Aug. 6, 2013 for U.S. Appl. No. 13/484,806.

PCT International Preliminary Report on Patentability in International Application No. PCT/US2012/060028, Date of Issuance: Apr. 15, 2014, 6 pages.

Notice of Allowance in U.S. Appl. No. 13/484,806, Date Mailed: Apr. 24, 2014 18 pages.

European Search Report dated Mar. 10, 2015 in Application No. 12840048.8, 7 pages.

European Search Report dated Mar. 10, 2015 in Application No. 12840485.2, 7 pages.

* cited by examiner

LIGHTWEIGHT MODULAR GOLF BAG HAVING EXTERNAL FRAME

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to golf bags. More particularly, the present invention relates to lightweight golf bags having an external frame and modular storage compartments that can be attached to the external frame in a variety of configurations.

BACKGROUND

Golf bags have long been an essential part of the game of golf due to the difficulty of carrying the number of clubs required to play properly. Conventionally, a golf bag is designed with a main compartment for holding golf clubs and a variety of accessory compartments for holding items such as golf balls, tees, towels, etc. Conventional golf bags are also made of robust materials that make the bag somewhat heavy. Carrying a heavy bag can fatigue a golfer and adversely affect the golfer's performance. Additionally, accessory compartments not being used by a golfer remain part of the bag and must be carried, adding additional weight to an already heavy bag. A golfer may also wish for a different selection of compartments but is limited by the compartments selected by the manufacturer.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A modular golf bag having an external frame is provided. A frame top is capable of receiving golf clubs. A frame bottom is located approximately the length of a golf club below the frame top. A plurality of poles connect the frame top and the frame bottom. A pliable bag body internal to the plurality of poles extends between the frame top and the frame bottom such that a cavity capable of receiving golf clubs through the frame top is formed. A plurality of pole sleeves are attached to the pliable bag body. Each of the plurality of pole sleeves surrounds at least a portion of the length of one of the plurality of poles such that each of the plurality of poles runs through at least one pole sleeve. The plurality of pole sleeves provide structure to the pliable bag body by securing the pliable bag body to the plurality of poles in an extended position. At least one additional storage compartment may be detachably connected between at least two of the plurality of poles.

BRIEF DESCRIPTION OF THE DRAWINGS

The present invention is described in detail below with reference to the attached drawing figures, wherein.

DETAILED DESCRIPTION

Conventional golf bags are heavy, and the storage compartments of conventional golf bags are not configurable. The present invention provides modular golf bags that are lightweight and have an external frame. Modular additional storage compartments can be detachably connected to the external frame in a variety of configurations. Examples of the present invention are illustrated in FIGS. 1-10.

Figure 1:
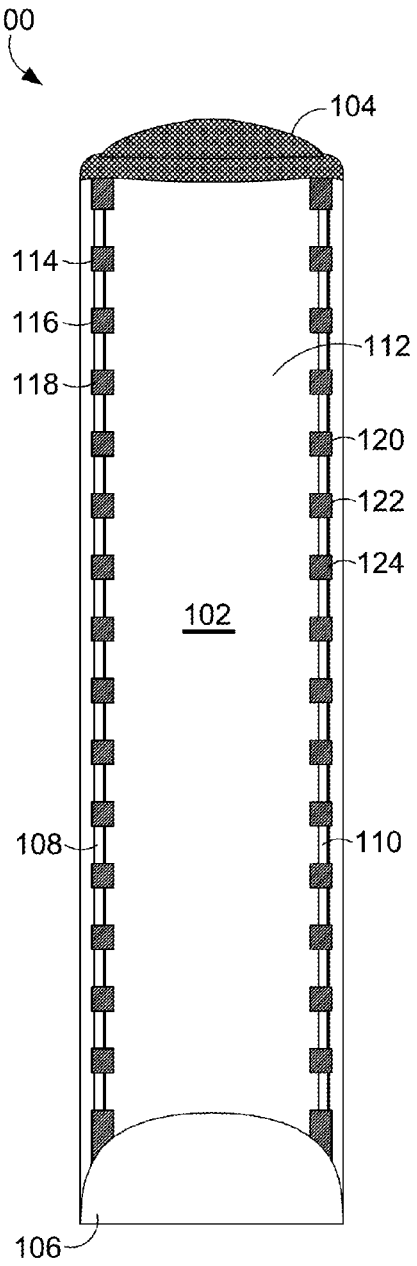
FIG. 1 is a back perspective view of a modular golf bag in accordance with an example of the present invention, the golf bag having a large number of pole sleeves spaced along the length of each pole.

FIG. 1 illustrates front side 102 of modular golf bag 100. Frame top 104 is capable of receiving golf clubs. In some examples frame top 104 is open. In other examples, frame top 104 includes a rim and zippered covering. Frame bottom 106 is located approximately the length of a golf club below frame top 104. A plurality of poles 108 and 110 connect frame top 104 and frame bottom 106. Pliable bag body 112 is internal to poles 108 and 110. Pliable bag body 112 extends between frame top 104 and frame bottom 106 such that a cavity (not shown) capable of receiving golf clubs through frame top 104 is formed.

A plurality of pole sleeves 114, 116, 118, 120, 122, and 124 are attached to the pliable bag body. Each of pole sleeves 114, 116, and 118 surround at least a portion of the length of pole 108. Similarly, each of pole sleeves 120, 122, and 124 surround at least a portion of the length of pole 110. Each of poles 108 and 110 runs through at least one pole sleeve. Pole sleeves 114, 116, 118, 120, 122, and 124 provide structure to pliable bag body 112 by securing pliable bag body 112 to poles 108 and 110 in an extended position. Only pole sleeves 114, 116, 118, 120, 122, and 124 are numbered in FIG. 1 for clarity, but it is to be appreciated that FIG. 1 illustrates pole sleeves spaced across substantially the entire length of poles 108 and 110.

Figure 2:
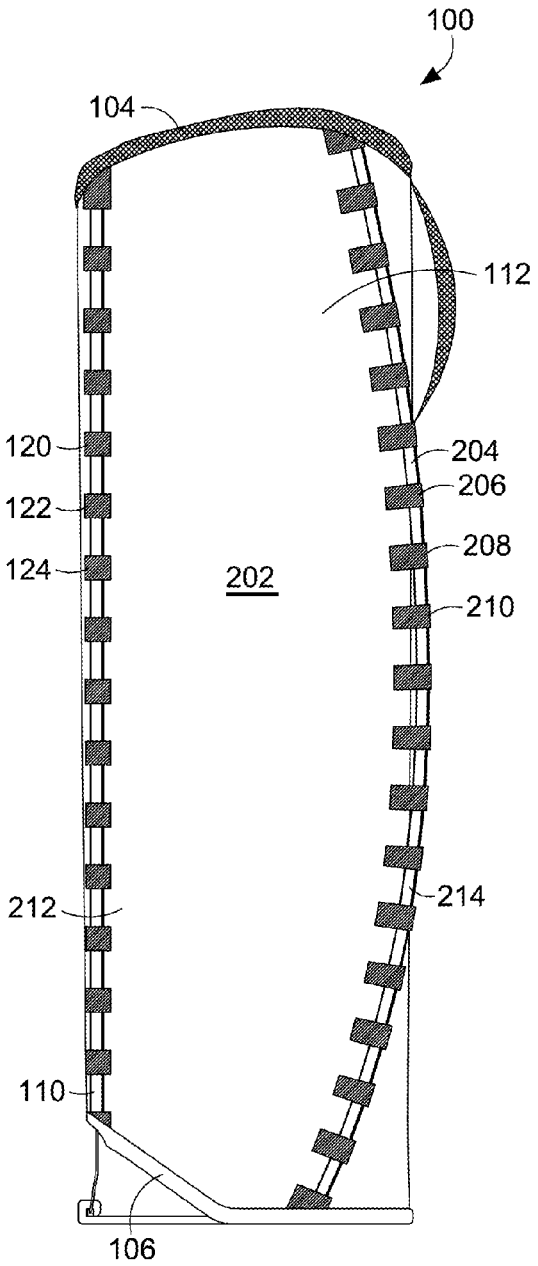
FIG. 2 is a side perspective view of the modular golf bag of FIG. 1.

FIG. 2 illustrates side 202 of modular golf bag 100 of FIG. 1. Pole 110, frame top 104, frame bottom 106, as well as pole sleeves 120, 122, and 124 shown in FIG. 1 are also visible in FIG. 2. A third pole 204 extends from frame top 104 to frame bottom 106. As with poles 108 and 110 shown in FIG. 1, pole 204 runs through a number of pole sleeves spaced along the length of pole 204, including pole sleeves 206, 208, and 210.

Although only three poles are visible in the perspectives illustrated in FIGS. 1 and 2, bag 100 comprises four poles. In some examples, a modular golf bag in accordance with the present invention includes two poles, three poles, four poles, or more than four poles. Poles 108 and 110 in FIG. 1 are substantially straight. Pole 204 in FIG. 2 is curved from frame top 104 to frame bottom 106. It is contemplated that the plurality of poles in various examples of modular golf bags in accordance with the present invention may have a variety of pole placement configurations as well as number of poles, including poles that cross over each other or extend diagonally from frame top to frame bottom.

The use of poles 108, 110, 204, and the fourth pole (not shown) running through pole sleeves provides a lightweight external frame for modular golf bag 100. An "external frame" has structural support substantially on the exterior of the bag body. In FIGS. 1 and 2, poles 108, 110, 204, and the fourth pole (not shown) substantially form the side boundaries of bag 100, and pliable bag body 112 extends from frame top 104 to frame bottom 106 internal to the side boundaries. By "internal," it is meant that pliable bag body 112 is substantially inside the area bounded by poles 108, 110, 204, and the fourth pole.

Poles 108, 110, and 204, provide structure to pliable bag body 112 by securing pliable bag body 112 to poles 108, 110, and 204 in an extended position. That is, the external frame provided by poles 108, 110, and 204 holds pliable bag body 112 in an "open" or "full" position as if pliable bag body 112 were inflated or full of a liquid. Bag 100 is designed such that when poles 108, 110, and 204 are run through the pole sleeves, pliable bag body 112 is substantially taut with each panel included in bag body 112 being extended between two or more poles. Because pliable bag body 112 is pliable, bag body 112 would not remain open and extended without the pole sleeves. In FIGS. 1 and 2, a plurality of portions of each pole are exposed and accessible. Exposed pole portions such as exposed portions 212 and 214, can be used as attachment points for additional storage compartments, as will be discussed with reference to FIGS. 7-10.

Figure 3:
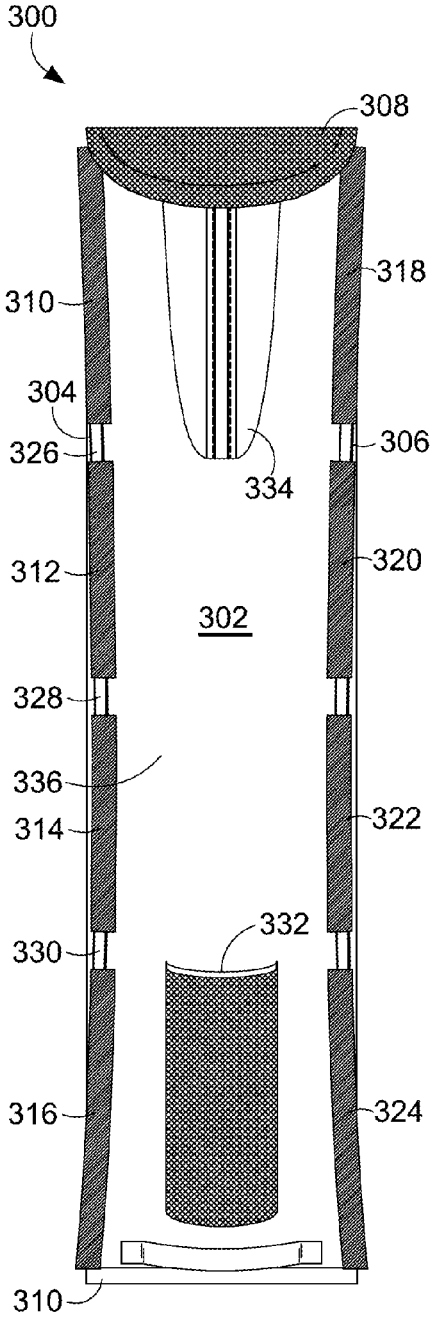
FIG. 3 is a front perspective view of a modular golf bag in accordance with an example of the present invention, the golf bag having a small number of pole sleeves spaced along the length of each pole.
Figure 4:
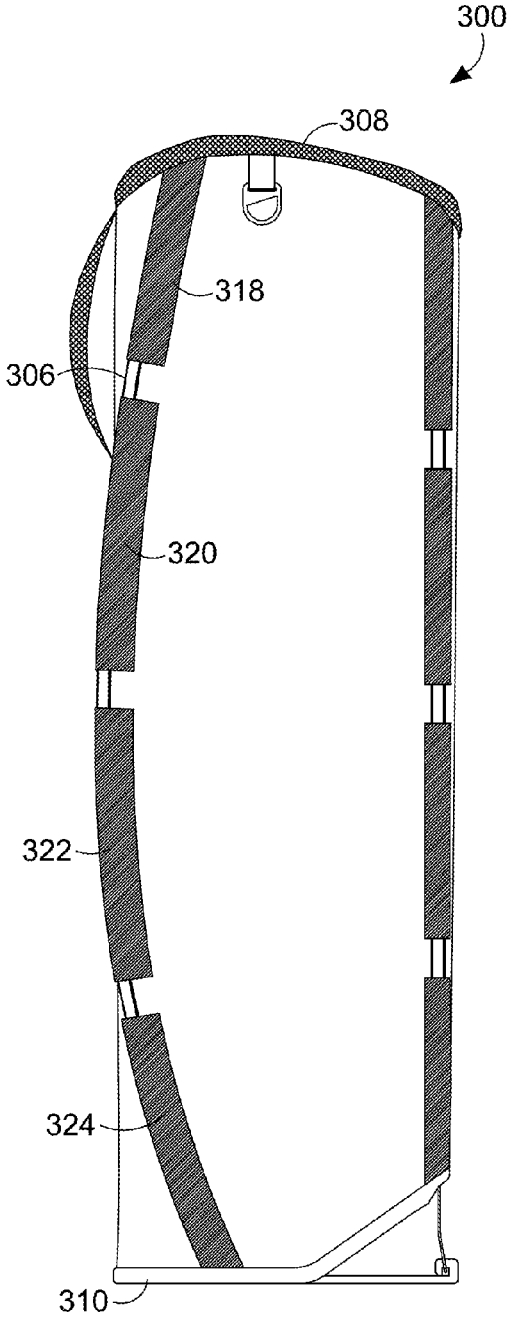
FIG. 4 is a side perspective view of the modular golf bag of FIG. 3.

Various configurations and types of pole sleeves are contemplated. FIGS. 3 and 4 illustrate modular golf bag 300, which has larger pole sleeves than those illustrated in FIGS. 1 and 2. Front 302 of bag 300 is shown in FIG. 3. Poles 304 and 306 extend from frame top 308 to frame bottom 310. Rather than the small pole sleeves illustrated in FIGS. 1 and 2, bag 300 has four larger pole sleeves spaced along the length of each pole, pole sleeves 310, 312, 314, and 316 spaced along the length of pole 304 and pole sleeves 318, 320, 322, and 324 spaced along the length of pole 306. In one example, pole sleeves 310, 312, 314, and 316 may be a single pole sleeve running substantially the length of pole 304 with apertures cut in the pole sleeve such that pole portions 326, 328, and 330 are exposed and accessible. An example of this type is shown and discussed in FIGS. 7-9.

In FIG. 3, modular golf bag 300 includes a water bottle compartment 332 and a grab handle 334 attached to pliable bag body 336. In some examples, no additional storage compartments are permanently attached to the pliable bag body. In other examples, one or more commonly desired additional storage compartments, such as water bottle compartment 332, are permanently attached. FIG. 4 illustrates a side perspective view of modular golf bag 300. Modular additional storage compartments may be detachably connected to examples of modular golf bags in accordance with the present invention, as illustrated in FIGS. 7-10.

Figure 5:
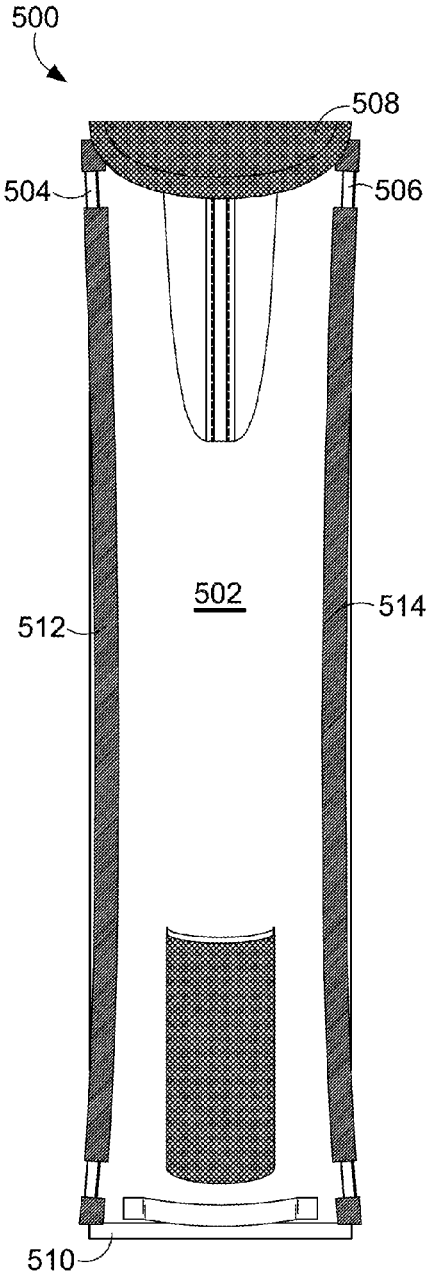
FIG. 5 is a front perspective view of a modular golf bag in accordance with an example of the present invention, the golf bag having a single pole sleeve for each pole.
Figure 6:
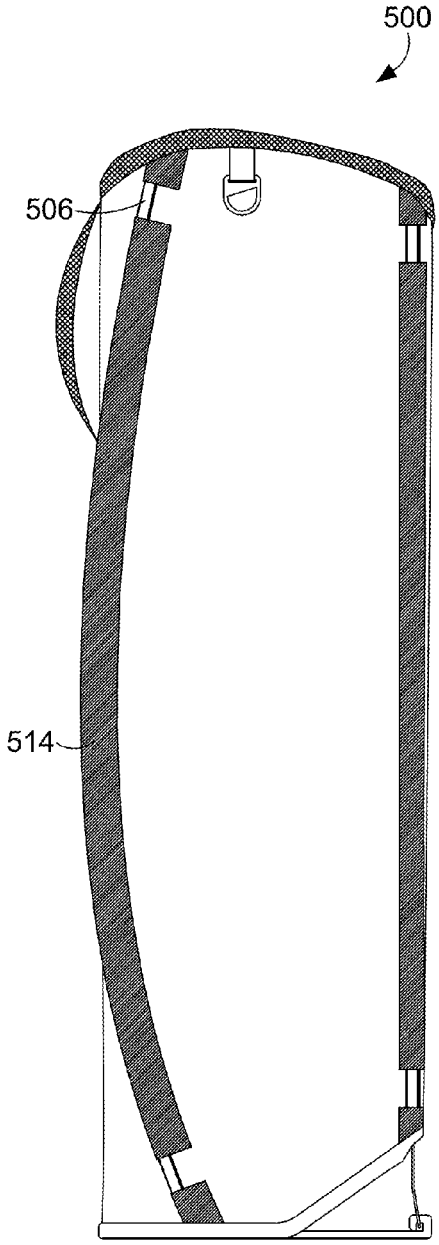
FIG. 6 is a side perspective view of the modular golf bag of FIG. 5.

FIG. 5 illustrates front 502 of modular golf bag 500. Poles 504 and 506 extend between frame top 508 and frame bottom 510. Pole 504 runs through pole sleeve 512, and pole 506 runs through pole sleeve 514. Pole sleeves 512 and 514 are substantially as long as poles 504 and 506. In some examples, the length of pole sleeves 512 and 514 is more than half the length of the corresponding pole. FIG. 6 illustrates a side perspective view of modular golf bag 500.

Figure 7:
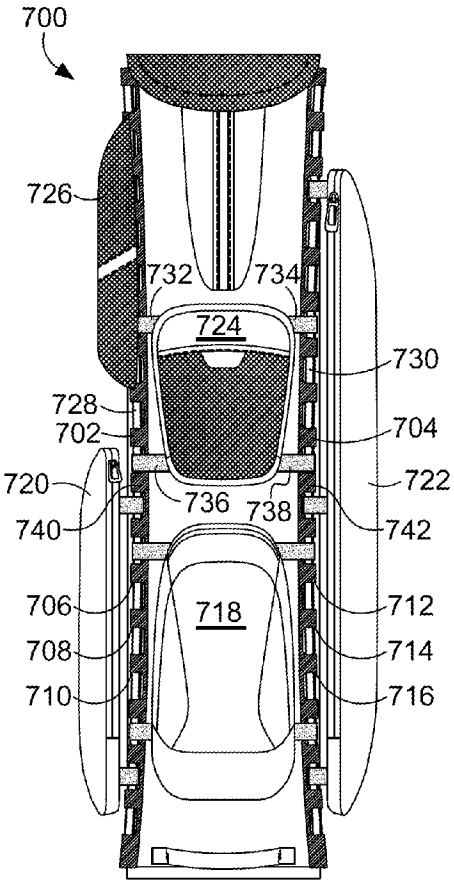
FIG. 7 is a front perspective view of a modular golf bag in accordance with an example of the present invention, the golf bag having pole sleeves with a plurality of apertures spaced along the length of each pole sleeve and a plurality of additional storage compartments.

FIG. 7 illustrates modular golf bag 700 having pole sleeves 702 and 704. Pole sleeves 702 and 704 have a plurality of apertures 706, 708, 710, 712, 714, and 716 spaced along the length of each pole sleeve. It is to be appreciated that while FIG. 7 shows apertures spaced along substantially the entire length of pole sleeves 702 and 704, only three exemplary apertures along each pole sleeve are numbered for clarity. As discussed above, in some examples pole sleeves 702 and 704 are divided into individual pole sleeves with no pole sleeves where the apertures are located.

Modular golf bag 700 also includes additional storage compartments 718, 720, 722, and 724 as well as back pad 726. Each of additional storage compartments 718, 720, 722, and 724 and back pad 726 is detachably connected between two poles. Additional storage compartments 718 and 724 are detachably connected between poles 728 and 730. The second pole to which additional storage compartments 720 and 722 and back pad 726 are detachably connected are shown in FIGS. 8 and 9.

Figure 9:
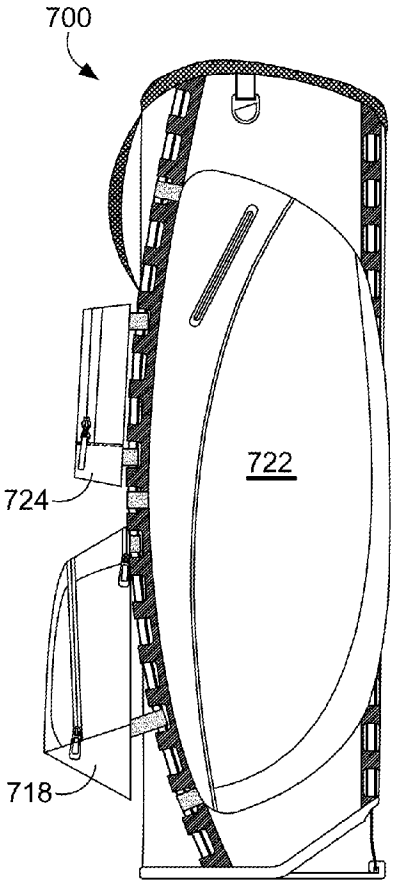
FIG. 9 is a side perspective view of the modular golf bag of FIGS. 7 and 8.
Figure 8:
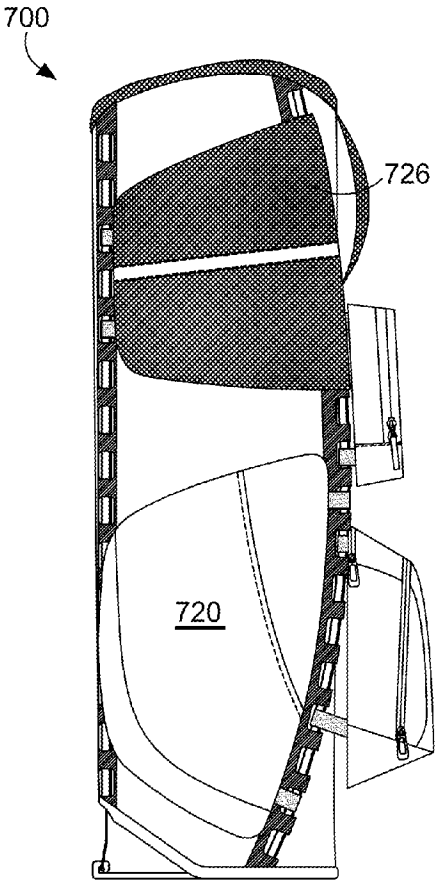
FIG. 8 is a side perspective view of the modular golf bag of FIG. 7.

FIGS. 7-9 illustrate additional storage compartments 718, 720, 722, and 724, as well as back pad 726, connected on exposed portions of the corresponding poles. Detachably connected additional storage compartments allow a golfer to select specific compartments to use with her bag. A golfer can add or remove compartments to react to changing circumstances to minimize weight and maximize functionality. Additionally, a golfer may select multiple compartments of a same type, reverse a typical accessory compartment layout to reflect that the golfer is left-handed or likes to position her bag in a certain way, or make other personalized modifications.

A detachable connection can be accomplished in a variety of ways, including each compartment having a plurality of straps with a buckle-type closure or having a connector to enable a compression fit, such as a hook or "c-shaped" piece. In FIG. 7, for example, additional storage compartment 724 is shown with straps 732, 734, 736, and 738 extending to and wrapping around poles 728 and 730 on exposed and accessible pole portions, where the bottom edge of straps 736 and 738 may be in direct contact with top edges of pole sleeves 740 and 742, respectively, when the additional storage compartment is detachably connected to exposed and accessible pole portions.

The exposed and accessible pole portions allow a strap to be wrapped completely around the exposed pole portion. In examples such as bag 500 of FIGS. 5 and 6 that have substantially pole-length pole sleeves, a compression fit may be more appropriate. In some examples, however, the pliable bag body itself may have slits to accommodate strapping an additional storage compartment around both a pole and corresponding pole sleeve even when a pole portion is not exposed and accessible. In such cases, connectors are in direct contact with the pole sleeve rather than exposed portions of the pole. Alternatively, a pole sleeve may not be attached to the pliable bag body along the entire length of the pole sleeve, leaving spaces for straps to wrap around both the pole and pole sleeve. Other connection mechanisms, such as grommets embedded in the pole sleeves, are also contemplated.

FIGS. 8 and 9 illustrate side views of modular golf bag 700. Although FIGS. 7-9 show each additional storage compartment detachably connected between only two poles, additional storage compartments may be detachably connected among three or more poles as well. Additional storage compartments are detachably connectable in a plurality of locations between at least two poles. For example, additional storage compartment 724 is shown detachably connected near the middle of bag 700, but compartment 724 may also be connected to a variety of other attachment points. In one specific example, additional storage compartments 718 and 724 could be interchanged.

The modular nature of golf bag 700 allows a plurality of different additional storage compartments to be detachably connected between the same attachment points, and, depending on the placement of the poles, allows a particular additional storage compartment to be detachably connectable both between attachment points of a first plurality of poles as well as between attachment points of a second plurality of poles, the first plurality being different from the second plurality. "Attachment points" refer to any potential place where an additional storage compartment can be connected. Thus, attachment points will vary depending on the design of the modular golf bag. In FIGS. 7-9, each exposed pole portion is an attachment point. If a compression fit with a c-shaped connector were used, each pole would be essentially one large connection point.

Figure 10:
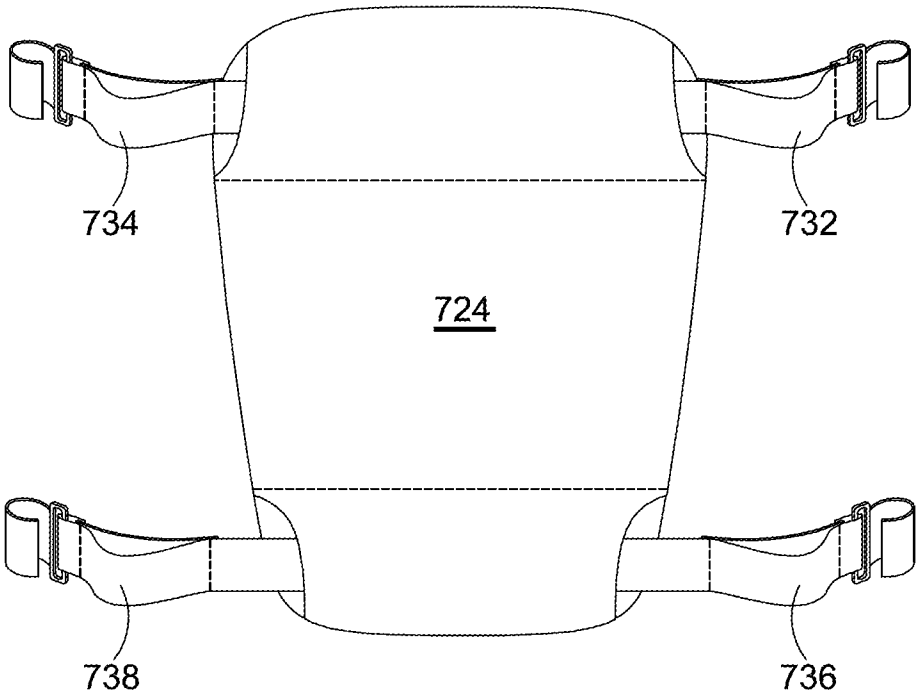
FIG. 10 is a back perspective view of additional storage compartment 724 shown in FIGS. 7-9.

A back view of additional storage compartment 724 is shown in FIG. 10. Straps 732, 734, 736, and 738 extend from additional storage compartment 724 and are wrapped around exposed pole portions. FIG. 10 is exemplary; a variety of connection mechanisms are contemplated.

The various types of pole sleeves illustrated in FIGS. 1-9 may be attached to the pliable bag body in a variety of ways. In some examples, the pole sleeves may be sewn to the pliable bag body. Additionally, while the pole sleeves are shown as substantially evenly spaced, the sleeves may be spaced at any intervals or location desired. Poles may be made of fiberglass, aluminum, titanium, or other lightweight, sturdy materials. Pliable bag bodies may be made of nylon or other lightweight, strong materials, both natural and synthetic.

The present invention has been described in relation to particular examples, which are intended in all respects to be illustrative rather than restrictive. Alternative examples will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Having thus described the invention, what is claimed is:

1. A modular golf bag comprising:

a frame top;

a frame bottom located below the frame top, wherein at least a first pole, a second pole, and a third pole connect the frame top and the frame bottom;

a pliable bag body internal to at least the first pole, the second pole, and the third pole extending between the frame top and the frame bottom such that a cavity is formed by the pliable bag body;

a plurality of spaced pole sleeves attached to the pliable bag body and each surrounding at least a portion of a length of each of at least the first pole, the second pole, and the third pole, wherein the plurality of pole sleeves secure the pliable bag body to at least the first pole, the second pole, and the third pole in an extended position; and at least one additional storage compartment comprising at least four connectors configured to detachably connect the at least one additional storage compartment at exposed and accessible pole portions, wherein a first connector is detachably connects between a first and a second pole sleeve in the plurality of pole sleeves on the first pole, or the second pole, or the third pole, a second connector detachably connects between a third and a fourth pole sleeve in the plurality of pole sleeves on the same pole as the first connector, a third connector detachably connects between a fifth and a sixth pole sleeve in the plurality of pole sleeves on a pole other than the pole used for the first and second connectors, and a fourth connector to detachably connects between a seventh and an eighth pole sleeve in the plurality of pole sleeves on the same pole used for the third connector, thereby connecting the additional storage compartment between at least two poles with the at least four connectors, at least one of said connectors extending at least a major distance of the spacing between two adjacent of said pole sleeves on the same pole.

2. The modular golf bag of claim 1, wherein the at least one additional storage compartment is connected such that at least the first connector and the second connector of the at least one additional storage compartment are in direct contact with the respective first or the second pole sleeve in the plurality of pole sleeves for the first connector, and the third or the fourth pole sleeve in the plurality of pole sleeves for the second connector.

3. The modular golf bag of claim 1, wherein the at least one additional storage compartment is detachably connectable in a plurality of locations between at least the first pole and the second pole, the first pole and the third pole, or the second pole and the third pole.

4. The modular golf bag of claim 1, wherein each of the at least the first pole, the second pole, and the third pole runs through a pole sleeve having a plurality of apertures spaced along the length of the pole sleeve.

5. The modular golf bag of claim 4, wherein a plurality of different additional storage compartments can be detachably connected at the same location as the at least one additional storage compartment.

6. A modular golf bag comprising:

a frame top;

a frame bottom located below the frame top, wherein at least a first pole, a second pole, a third pole, and a fourth pole connect the frame top and the frame bottom;

a pliable bag body internal to at least the first pole, the second pole, the third pole, and the fourth pole, the pliable bag body extending between the frame top and the frame bottom such that a cavity is formed by the pliable bag body;

a plurality of spaced pole sleeves attached to the pliable bag body and each surrounding at least a portion of the length of each of at least the first pole, the second pole, the third pole, and the fourth pole, wherein the plurality of pole sleeves secure the pliable bag body to at least the first pole, the second pole, the third pole, and the fourth pole in an extended position; and at least one additional storage compartment comprising at least four connectors to detachably connect the at least one additional storage compartment to attachment points on at least two of the at least first pole, the second pole, the third pole, or the fourth pole, wherein a first connector of the at least four connectors detachably connects at a first aperture on a first pole sleeve covering one of the first pole, the second pole, the third pole, or the fourth pole, and a second connector of the at least four connectors detachably connects at a second aperture on the first pole sleeve, a third connector of the at least four connectors detachably connects at a third aperture on a second pole sleeve covering one of the first pole, the second pole, the third pole, or the fourth pole other than the one covered by the first pole sleeve, and a fourth connector detachably connects at a fourth aperture on the second pole sleeve, thereby connecting the additional storage compartment between at least two poles with the at least four connectors, at least one of said connectors extending at least a major distance of the spacing between two adjacent of said pole sleeves on the same pole.

7. The modular golf bag of claim 6, wherein a plurality of different additional storage compartments can be detachably connected between the same attachment points.

8. The modular golf bag of claim 6, wherein the at least one additional storage compartment is detachably connectable between attachment points of the first pole and the second pole, the first pole and the third pole, the first pole and the fourth pole, the second pole and the third pole, the second pole and the fourth pole, and the third pole and the fourth pole.

9. A modular golf bag comprising:

a frame top;

a frame bottom located below the frame top;

a first pole, a second pole, and a third pole connecting the frame top and the frame bottom;

a pliable bag body internal to the three poles extending between the frame top and the frame bottom such that a cavity is formed by the pliable bag body;

a plurality of spaced pole sleeves attached to the pliable bag body, wherein a first pole sleeve and a second pole sleeve in the plurality of spaced pole sleeves surround at least a portion of the first pole, a third pole sleeve and a fourth pole sleeve in the plurality of spaced pole sleeves surround at least a portion of the second pole, wherein the first, second, third, and fourth pole sleeves secure the pliable bag body to the first pole and the second pole in an extended position; and an additional storage compartment comprising two connectors detachably connecting the additional storage compartment to the first and second poles, wherein a first connector detachably connects between the first and the second pole sleeve on the first pole and a second connector detachably connects between the third pole sleeve and the fourth pole sleeve on the second pole, at least one of said connectors extending at least a major distance of the spacing between two adjacent of said pole sleeves on the same pole.

* * * * *